US010527036B2

(12) United States Patent
Blume

(10) Patent No.: US 10,527,036 B2
(45) Date of Patent: Jan. 7, 2020

(54) PUMP HOUSING WITH INLINE VALVE

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 119 days.

(21) Appl. No.: 15/330,213

(22) Filed: Aug. 23, 2016

(65) Prior Publication Data

US 2018/0058431 A1 Mar. 1, 2018

(51) Int. Cl.

| | |
|---|---|
| ***F04B 1/14*** | (2006.01) |
| ***F04B 1/12*** | (2006.01) |
| ***F04B 53/10*** | (2006.01) |
| ***F04B 53/16*** | (2006.01) |

(52) U.S. Cl.

CPC ..... *F04B 53/16* (2013.01); *F04B 1/0421* (2013.01); *F04B 53/10* (2013.01); *F04B 53/1087* (2013.01); *F04B 1/143* (2013.01)

(58) Field of Classification Search

CPC .. F04B 1/124; F04B 1/16; F04B 1/143; F04B 1/145; F04B 53/1087; F04B 53/16

USPC ..... 417/539

See application file for complete search history.

(56) References Cited

U.S. PATENT DOCUMENTS

| | | | | |
|---|---|---|---|---|
| 5,171,136 A * | 12/1992 | Pacht | F04B 53/1025 | 137/454.4 |
| 8,147,227 B1 * | 4/2012 | Blume | F04B 53/007 | 137/512 |
| 8,784,081 B1 * | 7/2014 | Blume | F04B 53/16 | 417/559 |
| 2006/0269433 A1 * | 11/2006 | Skinner | F04C 18/0215 | 418/55.2 |

* cited by examiner

*Primary Examiner* — Dominick L Plakkoottam
*Assistant Examiner* — Connor J Tremarche
(74) *Attorney, Agent, or Firm* — Gary W. Hamilton

(57) ABSTRACT

A plunger pump fluid end housing assembly comprising: a fluid end housing, multiple plungers, a single in-line suction valve and seat corresponding with each said plunger, a discharge valve and seat corresponding with each said plunger; wherein axis of said suction valve and seat are parallel with said plunger, and the suction manifold is positioned to feed the fluid chamber opposite the power end of the fluid end. Plunger chamber of said fluid end housing is square or rectangular in cross section with large fillets at corners and flats between said fillets. Said flats are approximately equal in width to radii of said fillets.

20 Claims, 17 Drawing Sheets

Section "B-B" of Figure 3A

Typical Fluid Flow, Suction Stroke

Bore Intersection Lines

Section "A-A" of Figure 7A

Section "B-B" of Figure 10A

Section "C-C" of Figure 10B

Section "D-D" of Figure 10B

Section "B-B" of Figure 12A

Section "C-C" of Figure 12B

Section "D-D" of Figure 12B

PUMP HOUSING WITH INLINE VALVE

FIELD OF THE INVENTION

The invention relates generally to high-pressure plunger pumps used, for example, in oil field operations. More particularly, the invention relates to an internal bore configuration that improves flow, improves cylinder filling, and incorporates structural features for stress-relief in high-pressure plunger pumps.

BACKGROUND

Engineers typically design high-pressure oil field plunger pumps in two sections: the (proximal) power section and the (distal) fluid section. The power section usually comprises a crankshaft, reduction gears, bearings, connecting rods, crossheads, crosshead extension rods, etc. Commonly used fluid sections usually comprise a plunger pump fluid end housing with multiple fluid chambers, each chamber having a suction valve in a suction bore, a discharge valve in a discharge bore, an access bore, and a plunger in a plunger bore, plus high-pressure seals, retainers, etc. FIG. 1 is a cross-sectional schematic view of a typical fluid end housing fluid chamber showing its connection to a power section by stay rods. A plurality of fluid chambers similar to that illustrated in FIG. 1 may be combined, as suggested in the Triplex fluid section housing schematically illustrated in FIG. 2.

Valve terminology varies according to the industry, e.g., pipeline or oil field service) in which the valve is used. In some applications, the term "valve" means just the moving element or valve body. In the present application, however, the term "valve" includes other components in addition to the valve body, e.g., various valve guides to control the motion of the valve body, the valve seat, and/or one or more valve springs that tend to hold the valve closed, with the valve body reversibly sealed against the valve seat.

Each individual bore in a plunger pump fluid end housing is subject to fatigue due to alternating high and low pressures which occur with each stroke of the plunger cycle. Conventional fluid end housings, also referred to as Cross-Bore blocks, typically fail due to fatigue cracks in one of the areas defined by the intersecting suction, plunger, access and discharge bores as schematically illustrated in FIGS. 3A-B.

To reduce the likelihood of fatigue cracking in the high-pressure plunger pump fluid end housings described above, a Y-block housing design has been proposed. The Y-block design, which is schematically illustrated in FIG. 4, reduces stress concentrations in a plunger pump housing such as that shown in FIG. 3A by increasing the angles of bore intersections above 90°. In the illustrated example of FIG. 4, the bore intersection angles are approximately 120°. A more complete cross-sectional view of a Y-block plunger pump fluid section end housing is schematically illustrated in FIG. 5.

Both Cross-Bore blocks and Y-blocks have several major disadvantages when used to pump heavy slurry fluids as typically utilized in oilfield fracturing service. A first disadvantage is related to the feeding of the plunger bore cavity on the suction stroke of the pump. Upon passing through the suction valve, the fluid must make a 90 degree turn in a Cross-Bore housing, or a 60 degree turn in a Y-block housing, into the plunger bore as illustrated in FIG. 6. This change in the direction of the heavy fluid robs the fluid of kinetic energy, hereafter referred to as fluid energy.

Fluid energy is normally added to the fluid by small supercharging pumps upstream from the plunger pump. Fluid energy is necessary to overcome fluid inertia and ensure complete filling of the inner pump cavity or volume on the suction stroke. If the fluid could possibly enter the housing inner cavity or volume in a linear or straight path, less fluid energy would be lost.

The second disadvantage of Cross-Bore blocks and Y-blocks relates to the large intersecting curved areas where the various bores intersect. Because the suction bore above the suction valve is almost as large as the plunger bore, the intersection area of the suction bore with the plunger bore is particularly large as illustrated in FIGS. 3A and 3B. While the intersection of the suction bore and the plunger bore is notably large, the intersection of the discharge bore and the plunger bore is almost as large.

As shown in FIGS. 7A and 7B, the intersecting cylindrical sections result in intersection curves that focus or concentrate the stresses generated by the internal pump pressures into a very small area. This small area is located at the bore intersection near the plane formed by the axis of the plunger and suction or discharge bore cylinders at the finite point of the intersection of the two cylinders. Because the intersection curve changes slope through three-dimensional space, this intersection cannot be easily chamfered or filleted by conventional machining techniques that would mitigate these stresses to a smaller extent. Indeed, complex computer finite element stress analysis calculations indicate that chamfering or filleting the corner intersection has minimal effect on reducing the stresses at this corner intersection.

The amount of stress at the intersecting bores of conventional fluid end housings is defined by the magnitude of the "Bore Intersection Pitch" as illustrated in FIGS. 3A, 3B, and 4. Any geometry that reduces the "Bore Intersection Pitch" will reduce the stress concentrations in the fluid end and increase the life of the fluid end by mitigating cyclic fatigue failure. Y-Block fluid end housing designs, such as those illustrated in FIG. 4, do reduce this pitch, but the reduction is insufficient to prevent cyclic fatigue failure of the fluid end housing when subjected to high pressure and long pumping cycles.

SUMMARY OF THE INVENTION

In accordance with embodiments of the invention, a fluid end housing assembly is disclosed, comprising a fluid end housing, suction manifold and multiple plungers, suction and discharge valves and seats, suction valve spring retainer/plunger spacers, various seals, and miscellaneous supporting components.

The fluid end housing of the present invention comprises multiple fluid chambers with each chamber having a suction bore that is aligned with the plunger bore, commonly referred to as an "in-line configuration," i.e., the bores are aligned. As such the axis of the suction bore is substantially co-linear with the plunger bore. The configuration of the suction bore of the present invention eliminates the loss of fluid energy present in fluid end housings of the prior art in which the suction fluid flow must undergo a right-angle turn to fill the plunger bore or inner cavity of the housing.

The fluid chamber of the housing of the present invention also includes a discharge bore with the centerline of said discharge bore being perpendicular to the plunger bore centerline. In the present invention, the peak stress at the intersection of the plunger, suction, and the discharge bores is significantly reduced by two design features. The first feature is co-linear arrangement of the plunger bore and the suction bore that eliminates the concentration of stresses at these two bores typical of fluid end housings of the prior art as shown in FIGS. 3A, 3B, 4, 7A, and 7B.

The second design feature is a rectangular or square cross-section of the plunger bore. The corners of the rectangular or square cross section are filleted with generously sized radii, resulting in four flat or planar areas on each side of the rectangular or square cross section. The intersection of the discharge port wholly within one of the planar areas of the rectangular or square plunger chamber significantly reduces the stress at said intersection. In the embodiments disclosed herein, the radius of said fillets at the corners of said rectangular cross-section ranges from 50 percent to 70 percent of the radius of the plunger packing bore.

In an alternate embodiment of the invention, the discharge port also contains a tapered oblong bore section, wherein the direction of the long axis of the oblong bore is parallel to the plunger bore. The short axis of the oblong discharge port bore is always equal or shorter than the width of the flat section of either of the four flat or planar areas on each side of the rectangular or square cross section of the plunger bore.

The combination of the rectangular or square cross-section of the plunger bore and the oblong section of the discharge port at the intersection with the plunger bore and the direction of the long axis of the oblong bore being parallel to the plunger bore result in all points of the bore intersection lying in a flat plane with zero bore intersection pitch. Computer analysis has confirmed that stress is reduced 60-80% compared to the stress values of fluid end of the prior art with a large bore intersection pitch.

The oblong port maintains flow area in the discharge port equal to the flow area in the discharge and suction seats in the fluid end housing assembly.

DETAILED DESCRIPTION OF PREFERRED EMBODIMENTS

Figure 1:
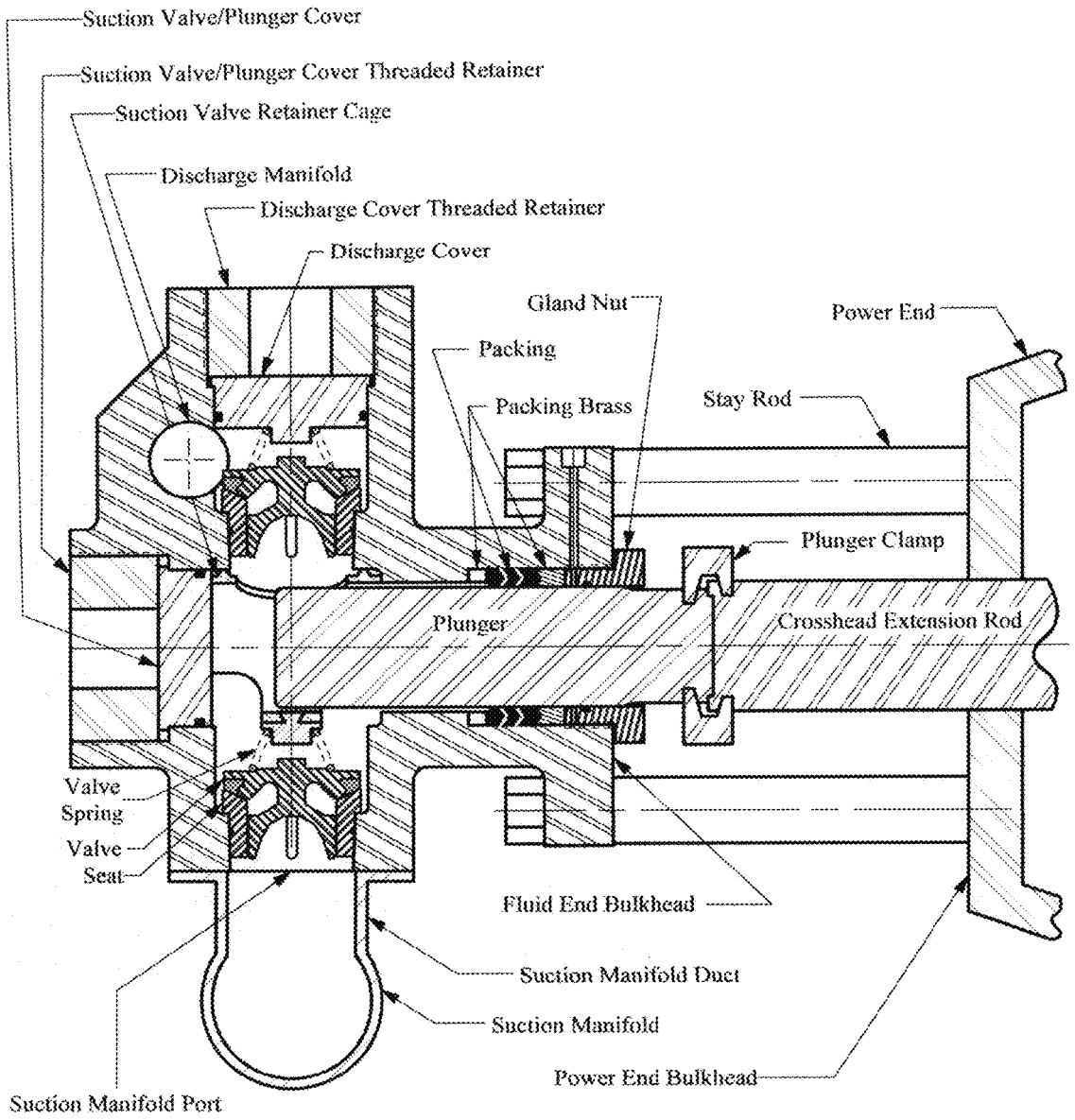
Prior Art Figure 1
FIG. 1 is a cross-sectional schematic view of a typical prior art plunger pump fluid section showing its connection to a power section by stay rods.
Figure 2:
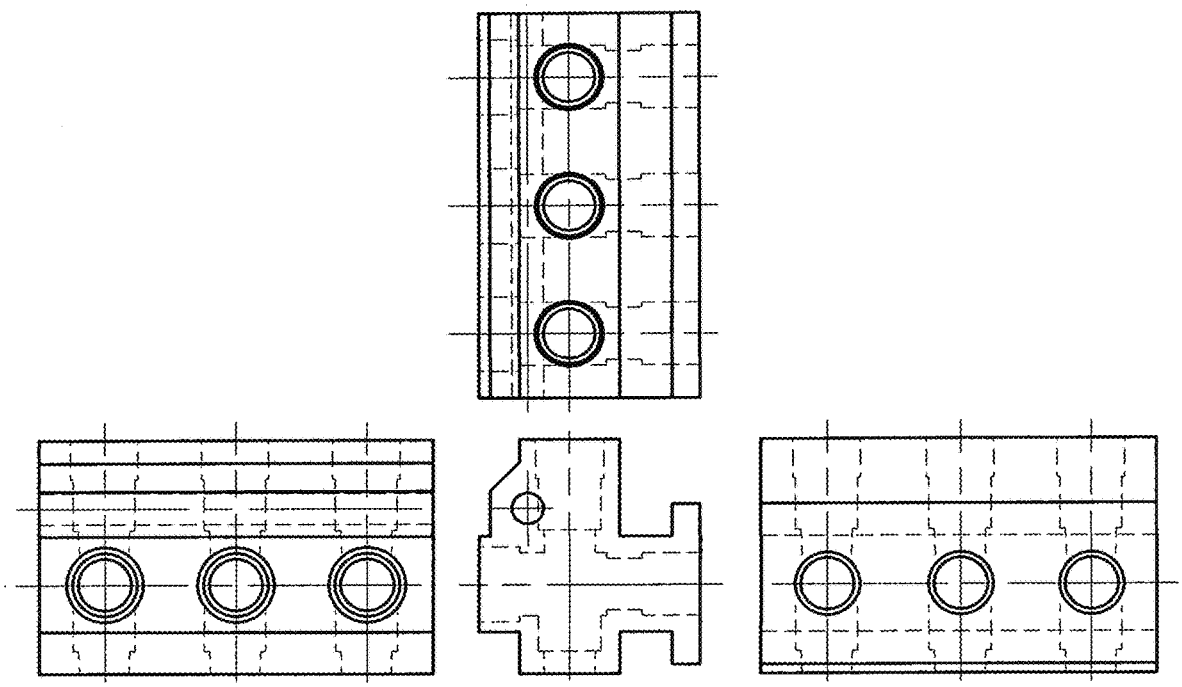
Prior Art Figure 2
FIG. 2 schematically illustrates a conventional prior art Triplex plunger pump fluid section housing.
Figure 3A:
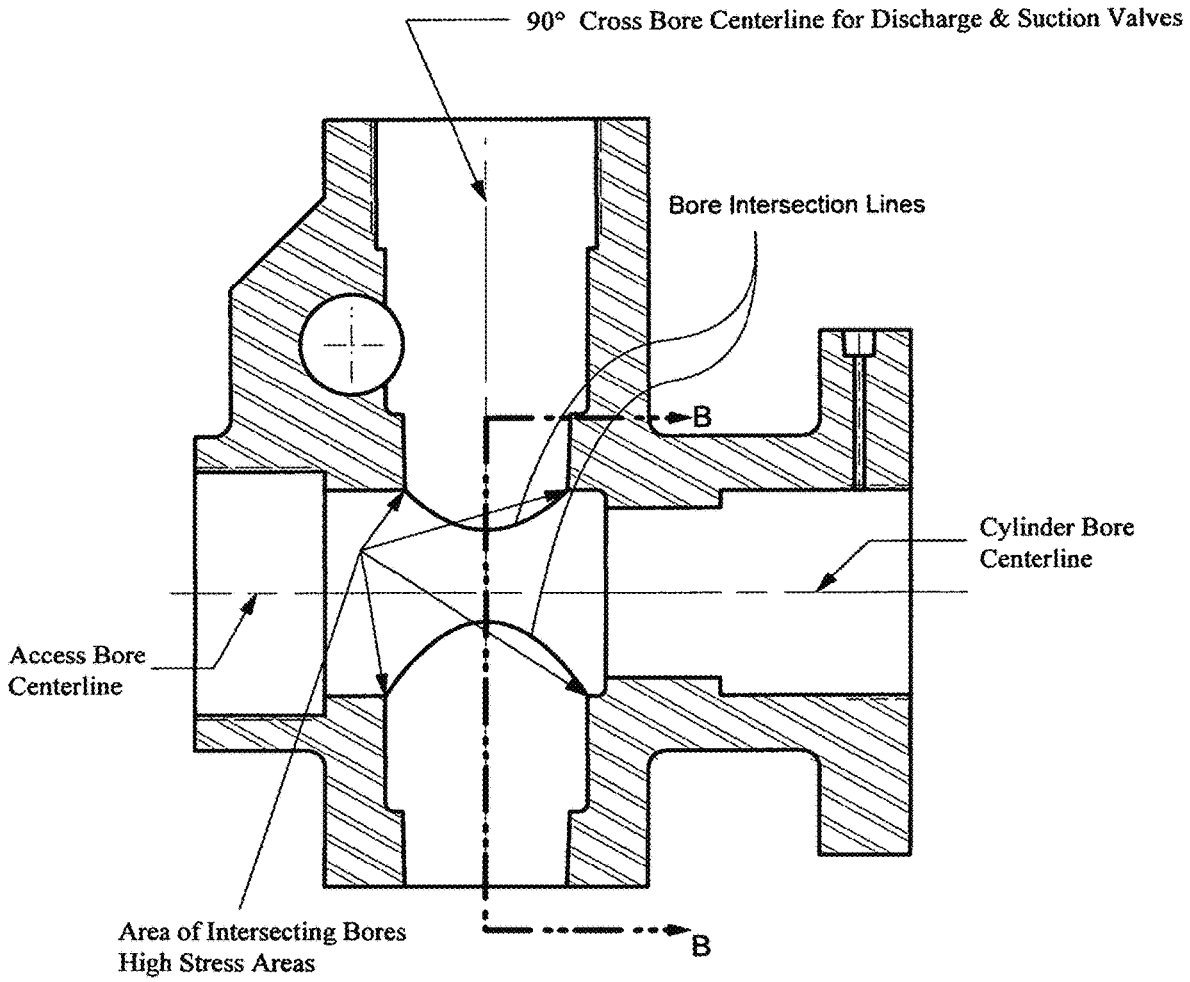
Prior Art Figure 3A
FIG. 3A is a cross-sectional schematic view of suction, plunger, access and discharge bores of a conventional prior art plunger pump housing intersecting at right angles and showing areas of elevated stress and the "Bore Intersection Pitch."
Figure 3B:
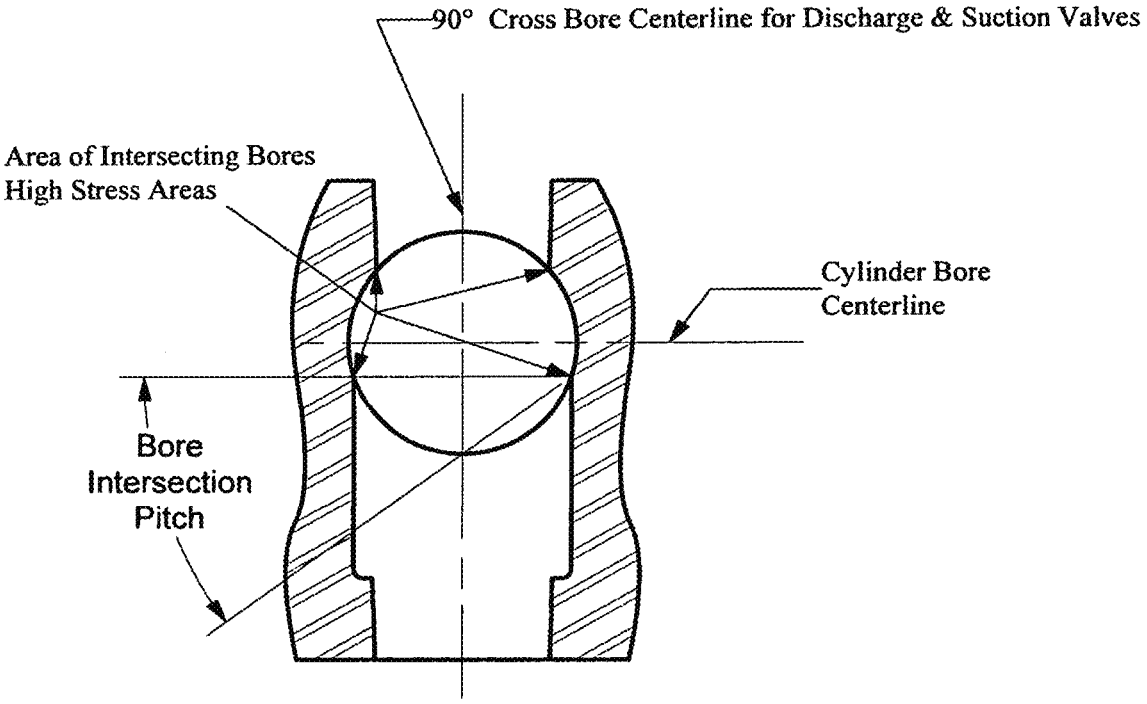
FIG. 3B schematically illustrates the sectional view labeled B-B in FIG. 3A.
Figure 4:
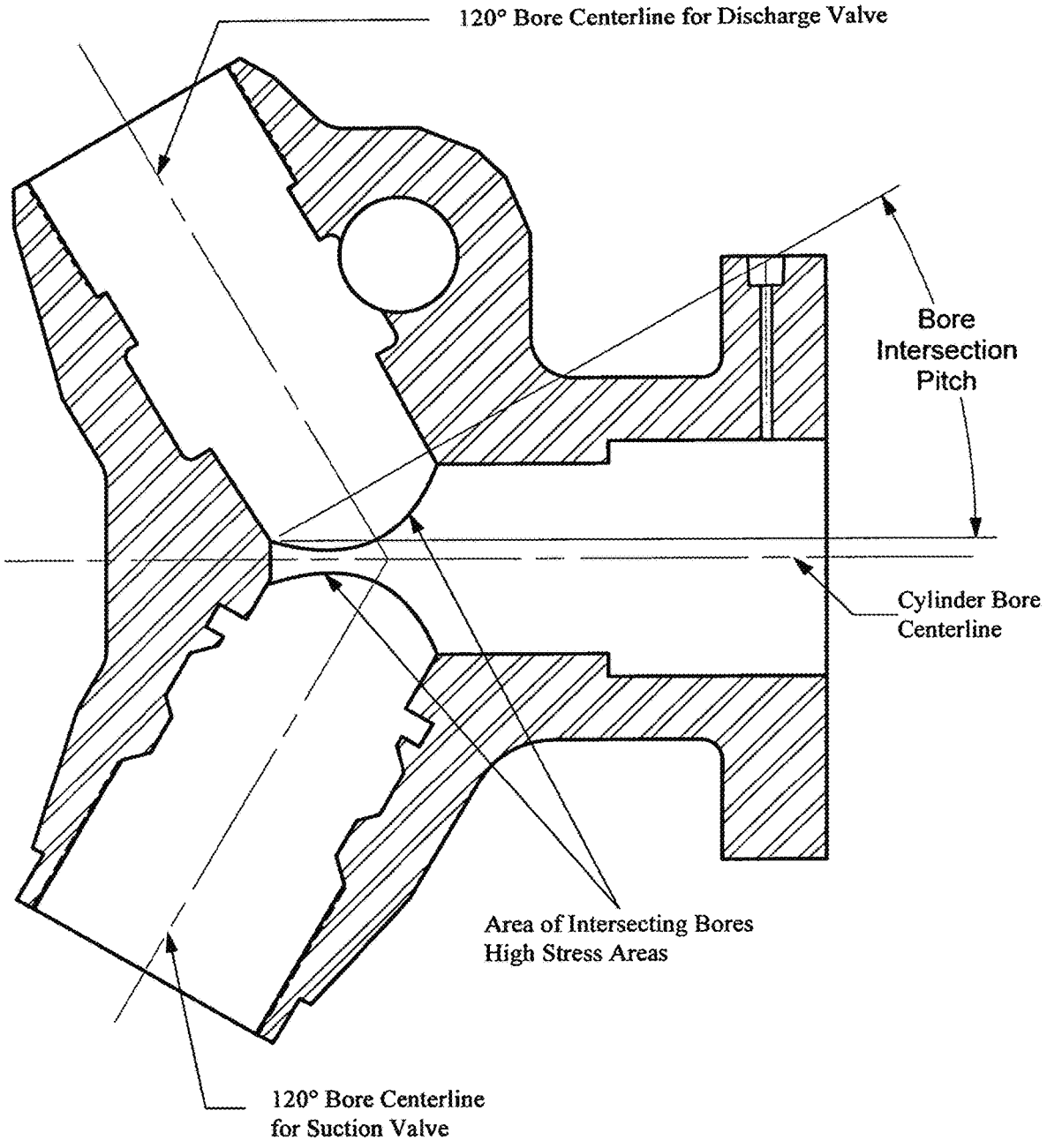
Prior Art Figure 4
FIG. 4 is a cross-sectional schematic view of suction, plunger and discharge bores of a prior art Y-block plunger pump housing intersecting at obtuse angles showing areas of elevated stress and the "Bore Intersection Pitch."
Figure 5:
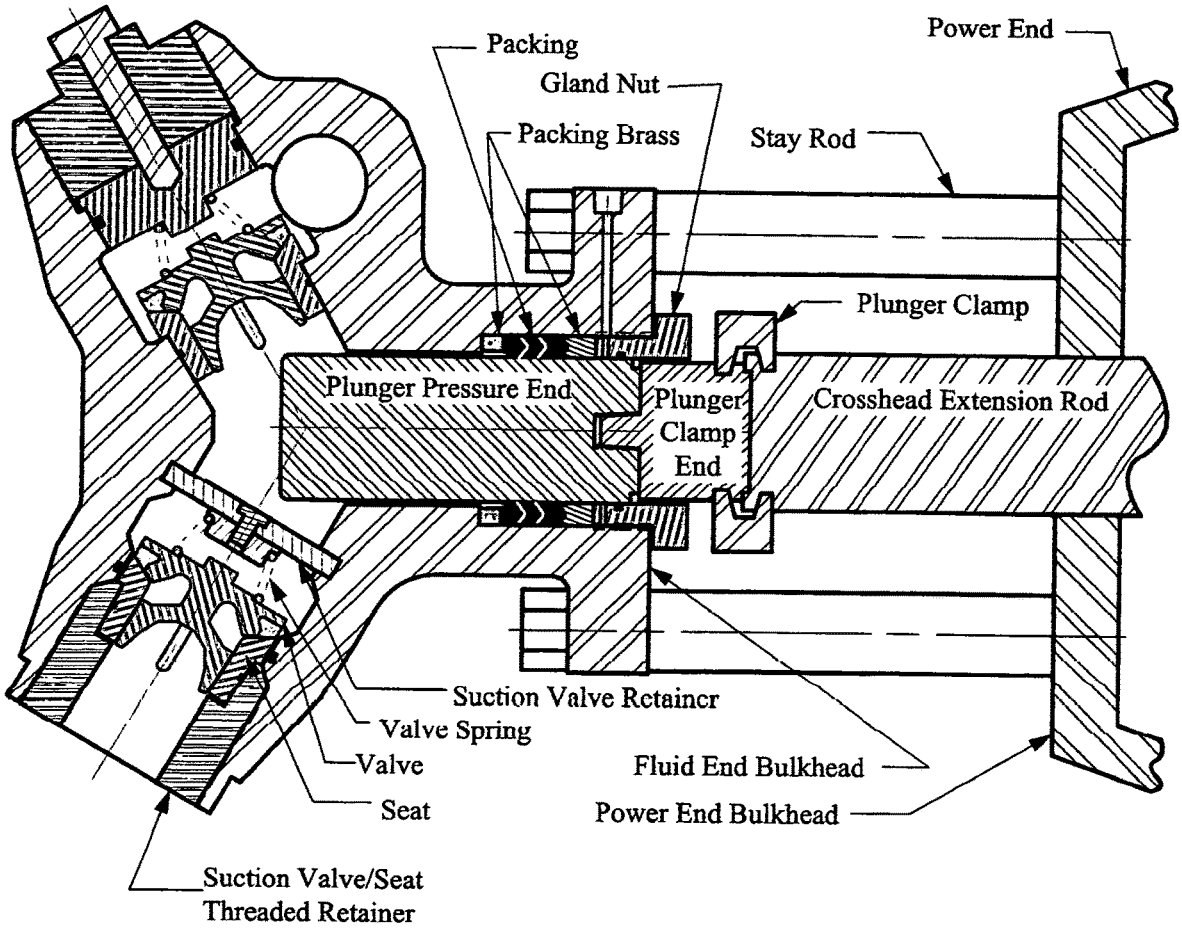
Prior Art Figure 5
FIG. 5 is a cross-sectional schematic view similar to that in FIG. 4, including internal plunger pump components of a prior art Y-block fluid section.
Figure 6:
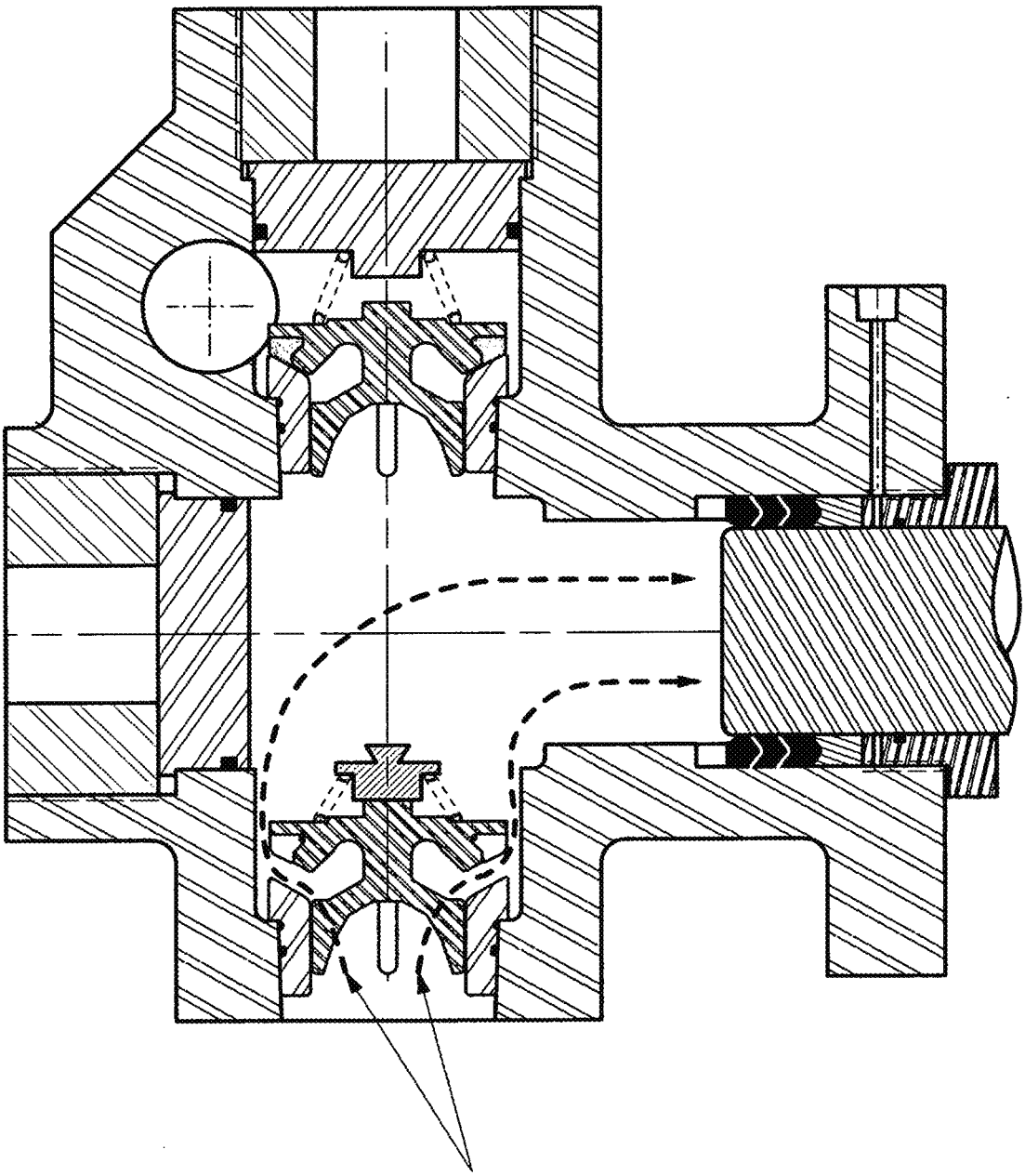
Prior Art Figure 6
FIG. 6 schematically illustrates a cross-section of a prior art right-angular plunger pump with valves, plunger, and a suction valve spring retainer showing the flow around the suction valve and the turn of the fluid into the plunger bore.
Figure 7A:
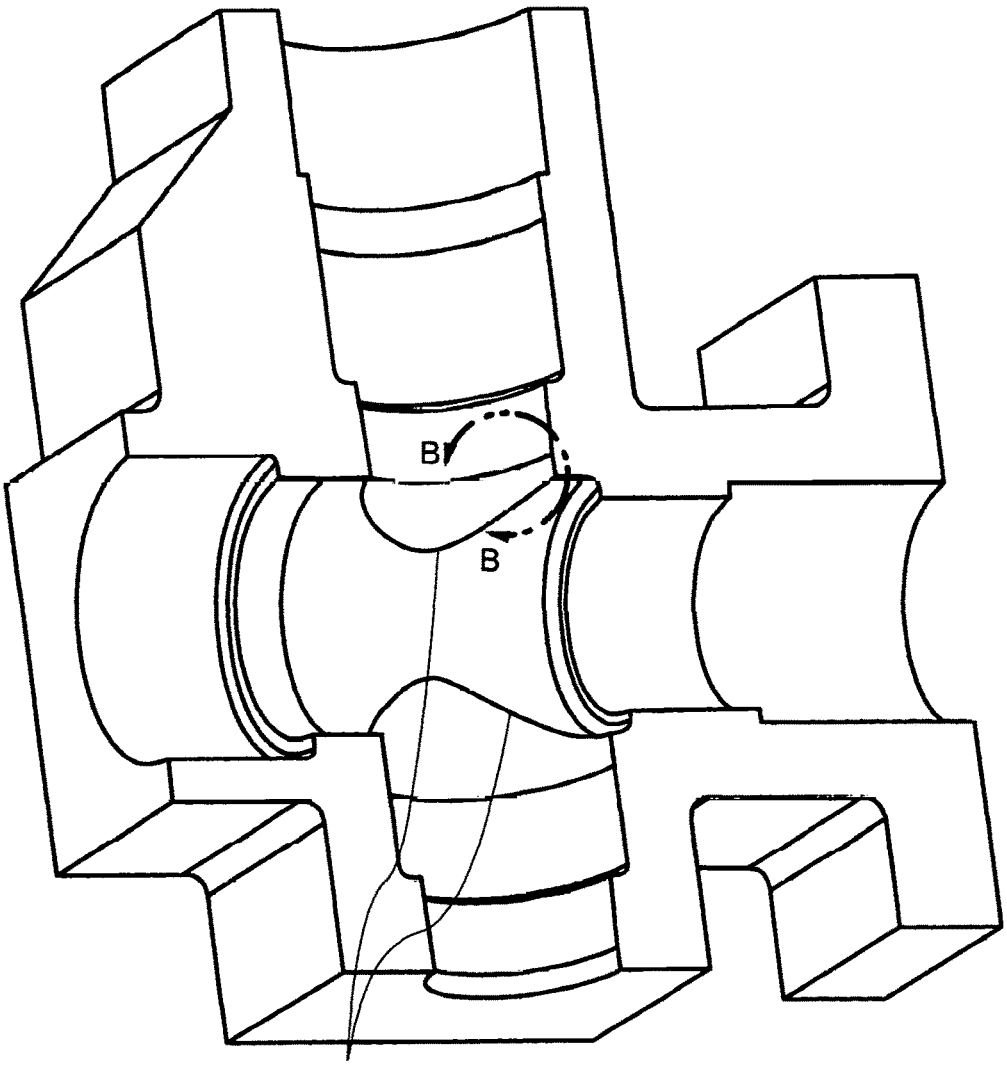
Prior Art Figure 7A
FIG. 7A schematically illustrates a three dimensional cross-section of one cylinder of a prior art right-angular plunger pump.
Figure 7B:
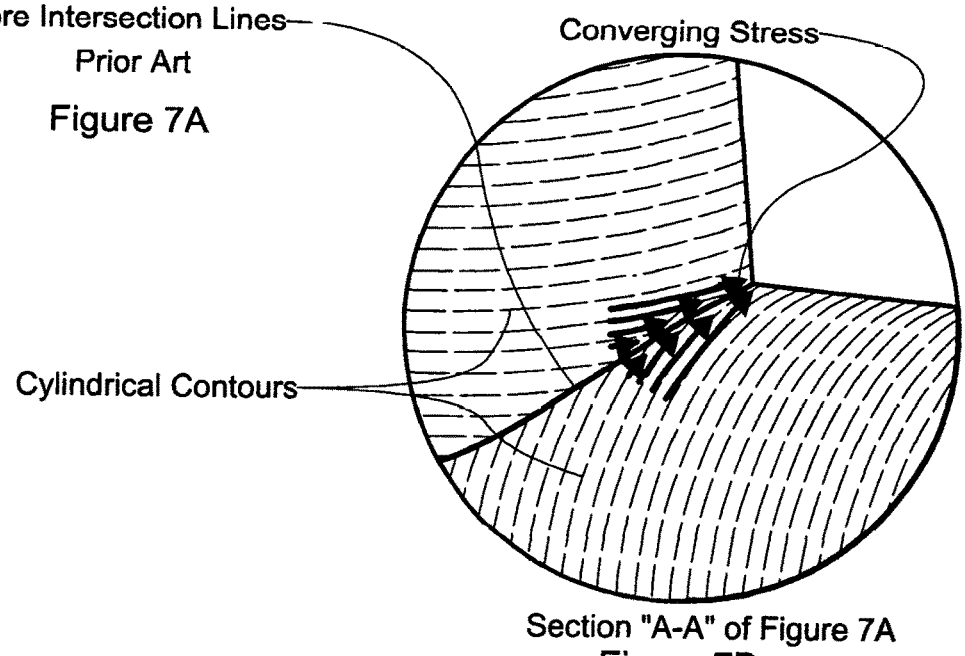
FIG. 7B schematically illustrates the enlarged sectional view labeled B-B in FIG. 7A highlighting the convergence of the stress at the intersection bores.
Figure 8:
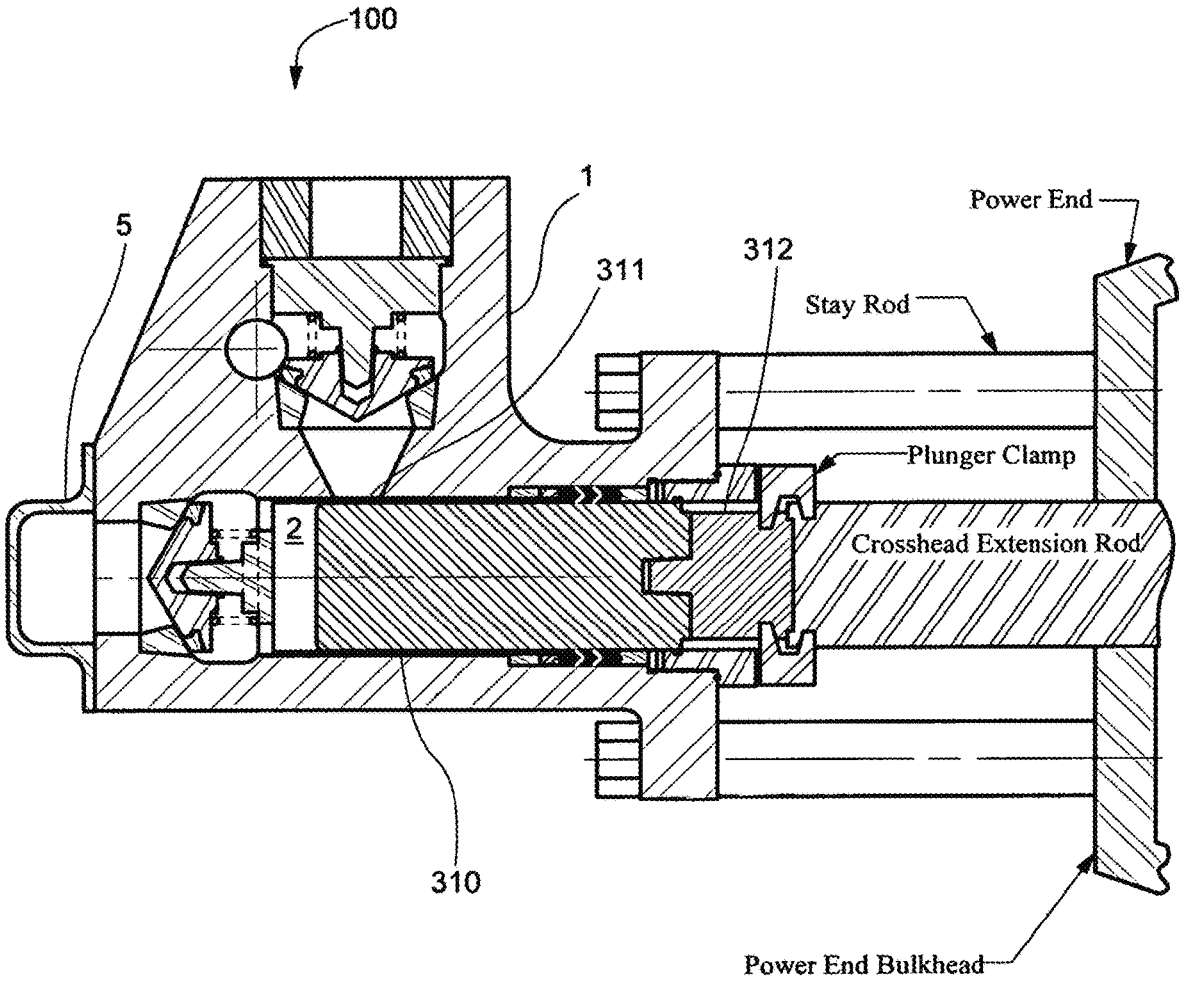
FIG. 8 schematically illustrates a cross-section of the fluid end housing assembly of the present invention showing its connection to a power section by stay rods.

FIG. 8 schematically illustrates a cross-section of an embodiment of the fluid end housing assembly 100 of the present invention showing its connection to a power section by stay rods. As opposed to fluid end housing of the prior art as illustrated in FIG. 1, fluid end housing 1 of the present invention is configured with the suction manifold 5 mounted in a position on the fluid end housing opposite the power end of the pump.

The housing 1 of the present invention features multiple fluid chambers 2 with each chamber 2 containing multiple bores. The plunger 310 may be of a two-piece design as illustrated in FIG. 8 with a plunger pressure end 311 and a plunger clamp end 312. A two-piece plunger facilitates easier maintenance by field mechanics. Alternately a one-piece plunger, not shown, could be utilized. However, a one-piece plunger would require removal of the fluid end housing assembly 100 from the power end assembly for routine maintenance on components of assembly 100.

Figure 9:
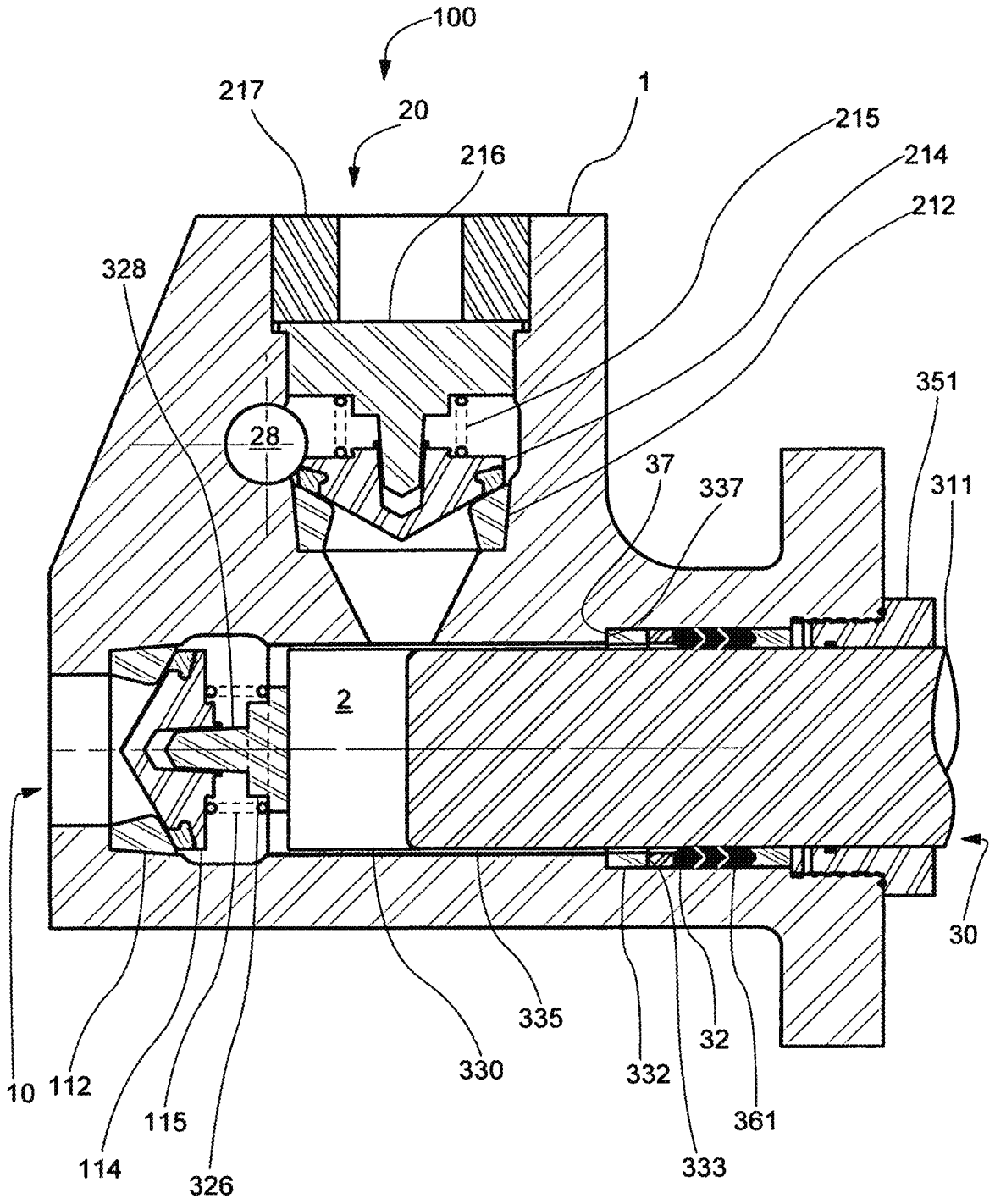
FIG. 9 schematically illustrates a cross-section of the fluid end housing assembly of the present invention including detailed cross sections of the components of the assembly.

FIG. 9 schematically illustrates a cross-section of the fluid end housing assembly 100 of the present invention showing the major internal components of the assembly 100 including a fluid end housing 1 featuring multiple fluid chambers 2 with each chamber 2 containing multiple internal bores 10, 20, and 30. Major internal components of the assembly 100 arranged in the plunger bore 30 of housing 1 include the plunger 311, plunger packing 361, plunger packing gland nut 351, and suction valve spring retainer/plunger spacer 330. The suction bore 10, opposite to the plunger bore 30, contains the suction seat 112, suction valve 114, suction valve spring 115, suction valve guide 328 and suction valve spring retainer 326. Suction valve guide 328 and suction valve spring retainer 326 are integral to the suction valve spring retainer/plunger spacer 330. Shoulder 337 and cylindrical surface 332 of flange 333 on plunger spacer 330 mates with shoulder 37 and plunger packing bore 32 of housing 1, respectively. Central section 335 of suction valve spring retainer/plunger spacer 330 connects flange 333 with suction valve spring retainer 326. The centerlines of the suction bore 10, suction seat 112, suction valve 114, suction valve spring 115, plunger bore 30, plunger 311, plunger packing 361, and plunger packing gland nut 351 are all substantially co-linear.

FIG. 9 schematically further illustrates the components in the discharge bore 20. Discharge bore 20 connects with discharge manifold 28 which connects with multiple fluid chambers 2 and exhausts pumped fluid externally from the fluid end housing 1. Discharge bore 20 contains a discharge seat 212, discharge valve 214, discharge valve spring 215, discharge cover 216, and discharge cover retainer 217.

Figure 10A:
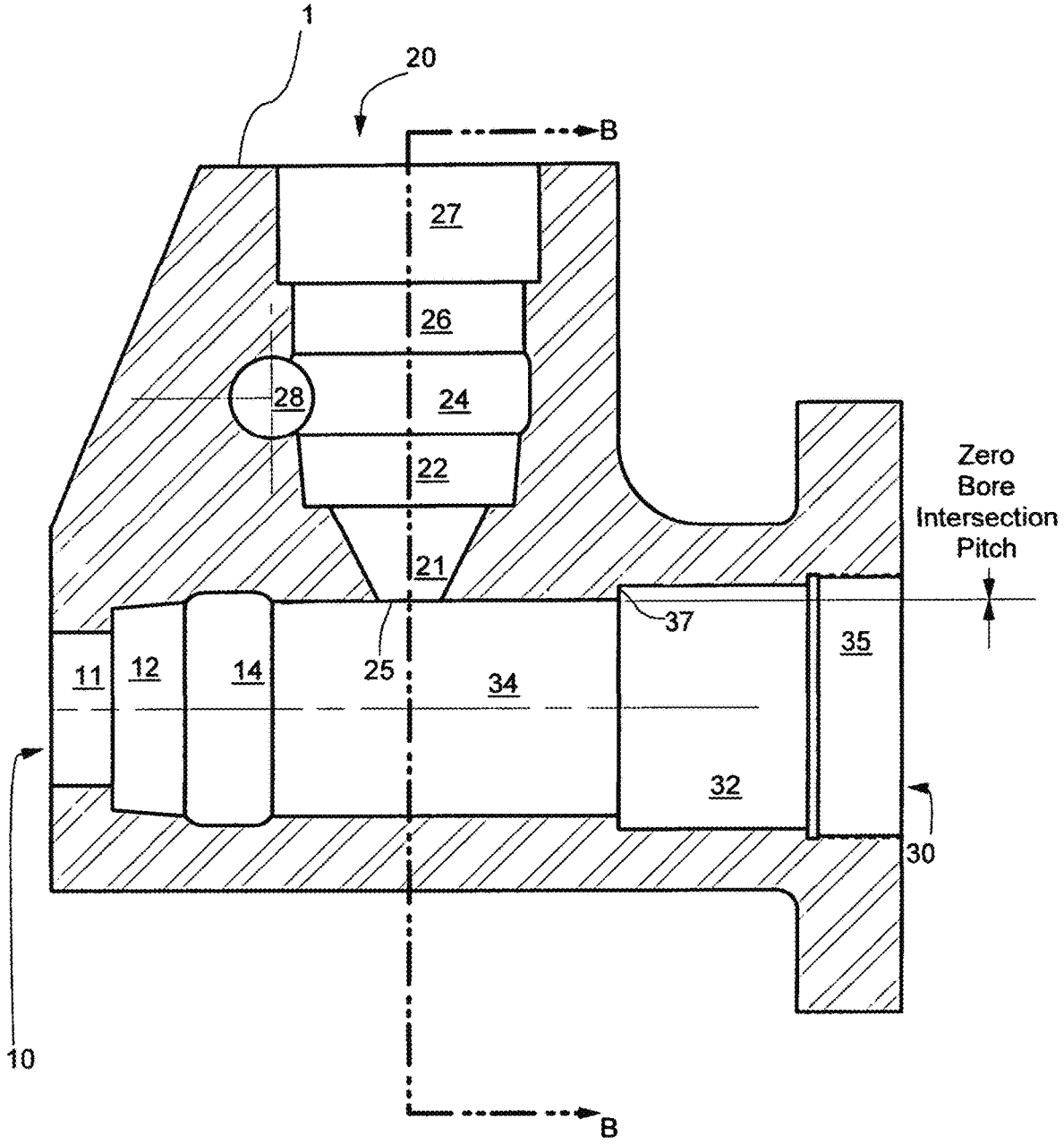
FIG. 10A schematically illustrates a cross-section of the fluid end housing of the present invention.

FIG. 10A is an illustration of the fluid end housing 1 showing plunger bore 30, suction bore 10, discharge bore 20, and discharge manifold bore 28 without the various other internal components shown in FIGS. 8 and 9. Plunger bore 30 contains a packing bore 32 for holding plunger packing 361 and a plunger chamber 34; plunger 311 reciprocates back and forth through the plunger chamber 34 and the plunger packing 361. Packing bore 30 also contains a plunger packing gland nut bore 35 for positioning of the plunger packing gland nut 351. Packing bore 32 is separated from the plunger chamber 34 by a packing shoulder 37 which mates with a shoulder 337 on suction valve spring retainer/plunger spacer 330 as shown in FIG. 11C. Plunger packing bore 32 also mates with the packing bore flange 337 of suction valve spring retainer/plunger spacer 330 as illustrated in FIG. 9. Central section 335 of suction valve spring retainer/plunger spacer 330 mates with plunger chamber 34 of plunger bore 30.

Suction bore 10 as illustrated in FIG. 10A contains a suction seat bore 12 that captures suction seat 112 and a suction valve bore 14 in which suction valve 114 controls fluid flow. Suction valve bore 14 also holds suction valve spring 115, suction valve spring retainer 326, and upper suction valve guide 328. Immediately adjacent to the suction seat area 12 is suction port 11 that connects the suction seat 112 and suction valve 114 with the suction manifold 5 as illustrated in FIGS. 8 and 9.

Discharge bore 20 of fluid end housing 1 contains a discharge seat bore 22 that captures the discharge seat 212 as shown in FIG. 9. Immediately adjacent to the discharge seat bore 22 is frusto-conical discharge port 21 that connects the discharge seat 212 and discharge valve 214 with plunger chamber 34 at the bore intersection 25. Upper discharge bore 20 of fluid end housing 1 also contains a discharge cover bore 26 and discharge cover retainer bore 27 that mates with discharge cover 216 and discharge cover retainer 217, respectively. Discharge valve bore 24 allows fluid passage from discharge seat 212 around discharge valve 214 and into discharge manifold 28.

Figure 10B:
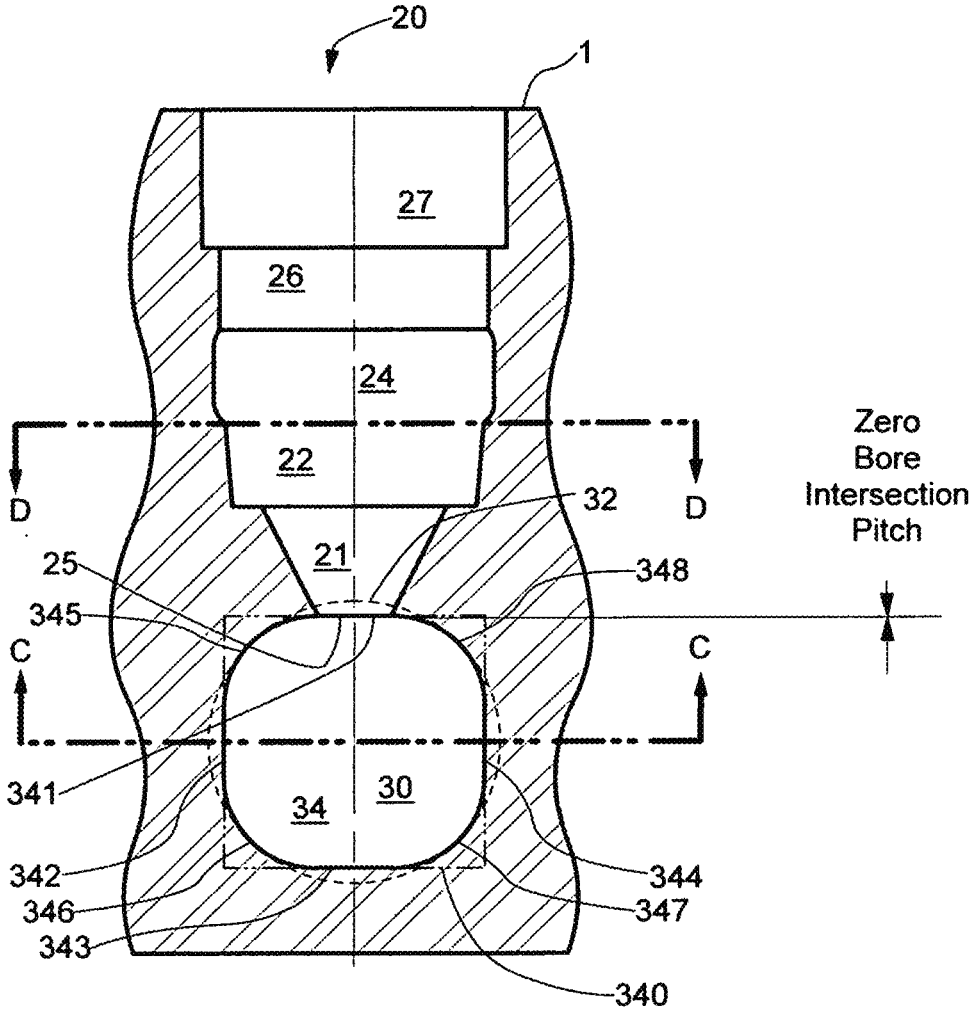
FIG. 10B schematically illustrates the sectional view labeled B-B in FIG. 10A.
Figure 10C:
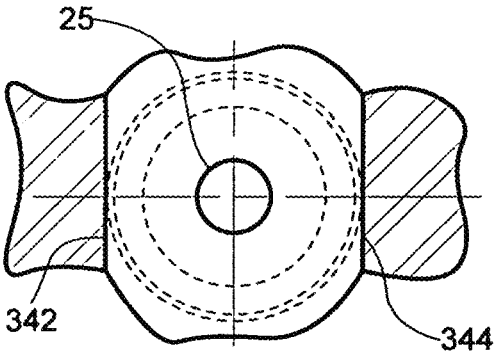
FIG. 10C schematically illustrates the sectional view labeled C-C in FIG. 10B.
Figure 10D:
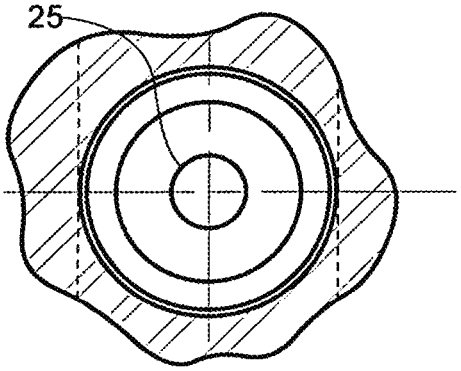
FIG. 10D schematically illustrates the sectional view labeled D-D in FIG. 10B.

FIG. 10B schematically illustrates Section "B-B" of FIG. 10A. FIG. 10C schematically illustrates Section "C-C" of FIG. 10B; and FIG. 10D schematically illustrates Section "D-D" of FIG. 10B. In FIG. 10B, broken line 340 indicates overall rectangular or square cross section of plunger chamber 34 portion of the plunger bore 30. Also shown are fillets 345, 346, 347, and 348 at the corners of the rectangular or square cross section 340 of the plunger chamber 34. Planar sections 341, 342, 343, and 344 are located on the sides of the rectangular or square cross section 340 of the plunger chamber 34. Discharge port 21 intersects plunger chamber 34 in planar section 341 to form intersection 25. The size of the radii of fillets 345, 346, 347, and 348 at the corners of the rectangular or square cross section of the plunger chamber 34 are equal or greater than the width of planar sections 341, 342, 343, and 344.

As shown in FIGS. 10A and 10B, discharge port 21 is frusto-conical in shape to accommodate the flow through the valve seat 212 at the major diameter at the top of the frusto-conical section. The reduced diameter at the bottom of the frusto-conical section 21 ensures that intersection 25 with plunger chamber 34 occurs wholly within planar section 341. Bore intersection 25 is totally flat i.e., lying wholly in a two-dimensional plane as compared with bore intersections of conventional fluid ends as shown in FIGS. 3A, 3B, 4, 7A, and 7B which have slopes diverging significantly ("warped") in three-dimensional space. The greater the warpage of the bore intersection, the greater the Bore Intersection Pitch and the greater the concentration of stresses at the bore intersections of the plunger bore with the suction or discharge bores in fluid end housings of the prior art. The stresses at the intersecting plunger and discharge bores of the present invention are significantly reduced over the stresses at the intersecting bores of the prior art.

Figure 11A:
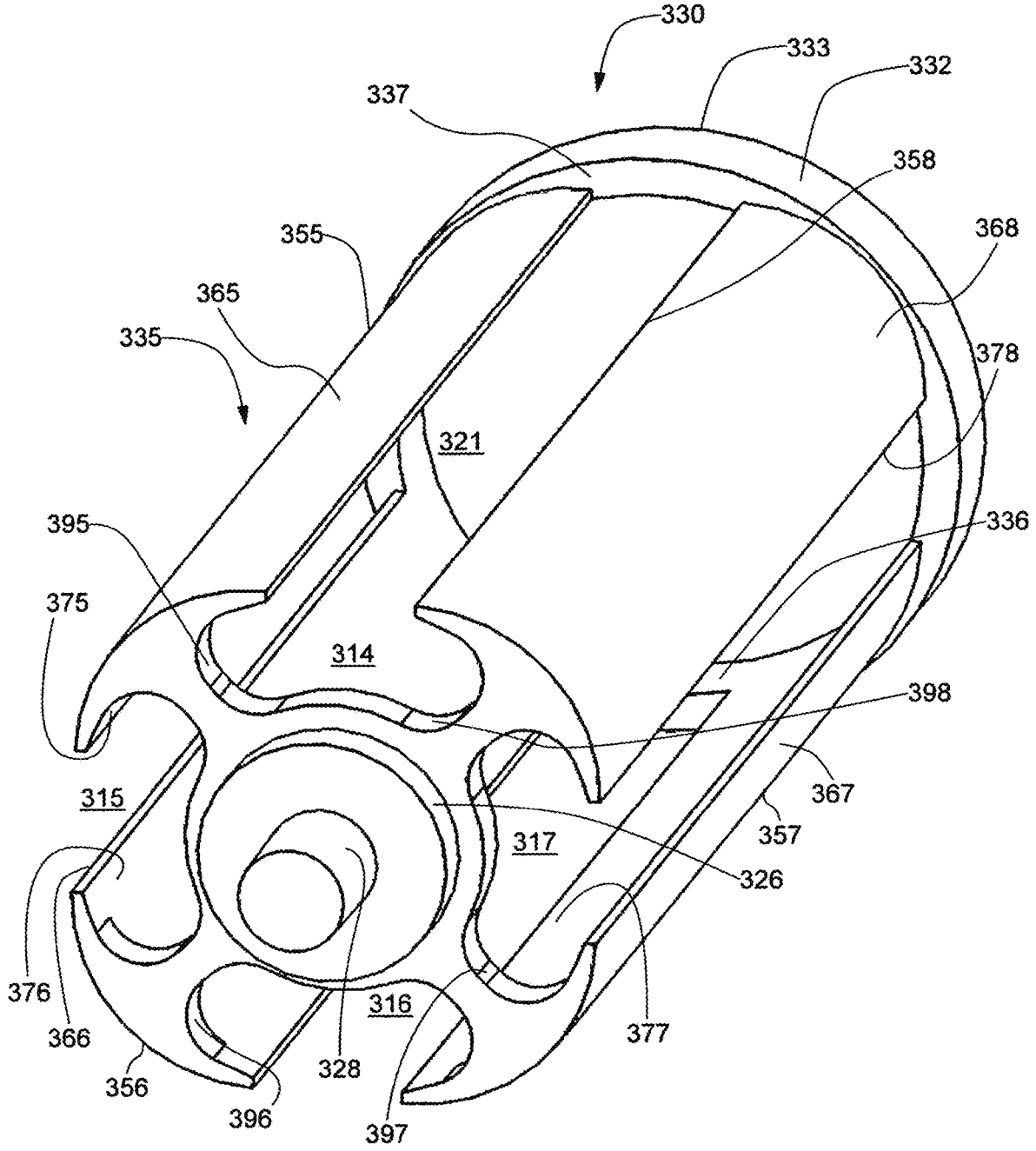
FIG. 11A schematically illustrates an orthogonal view of the suction valve spring retainer/plunger spacer.
Figure 11B:
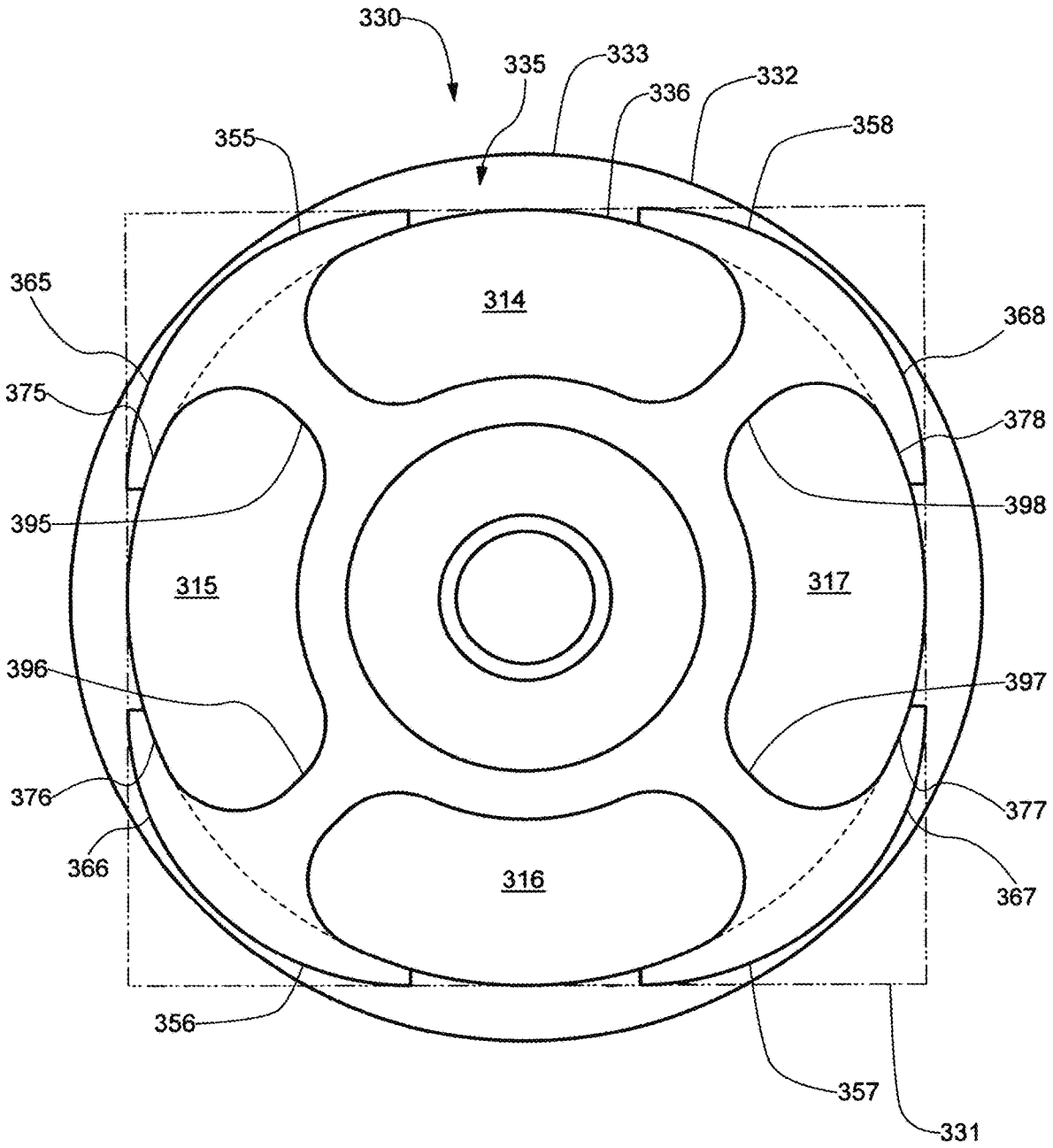
FIG. 11B schematically illustrates an end view of the suction valve spring retainer/plunger spacer.
Figure 11C:
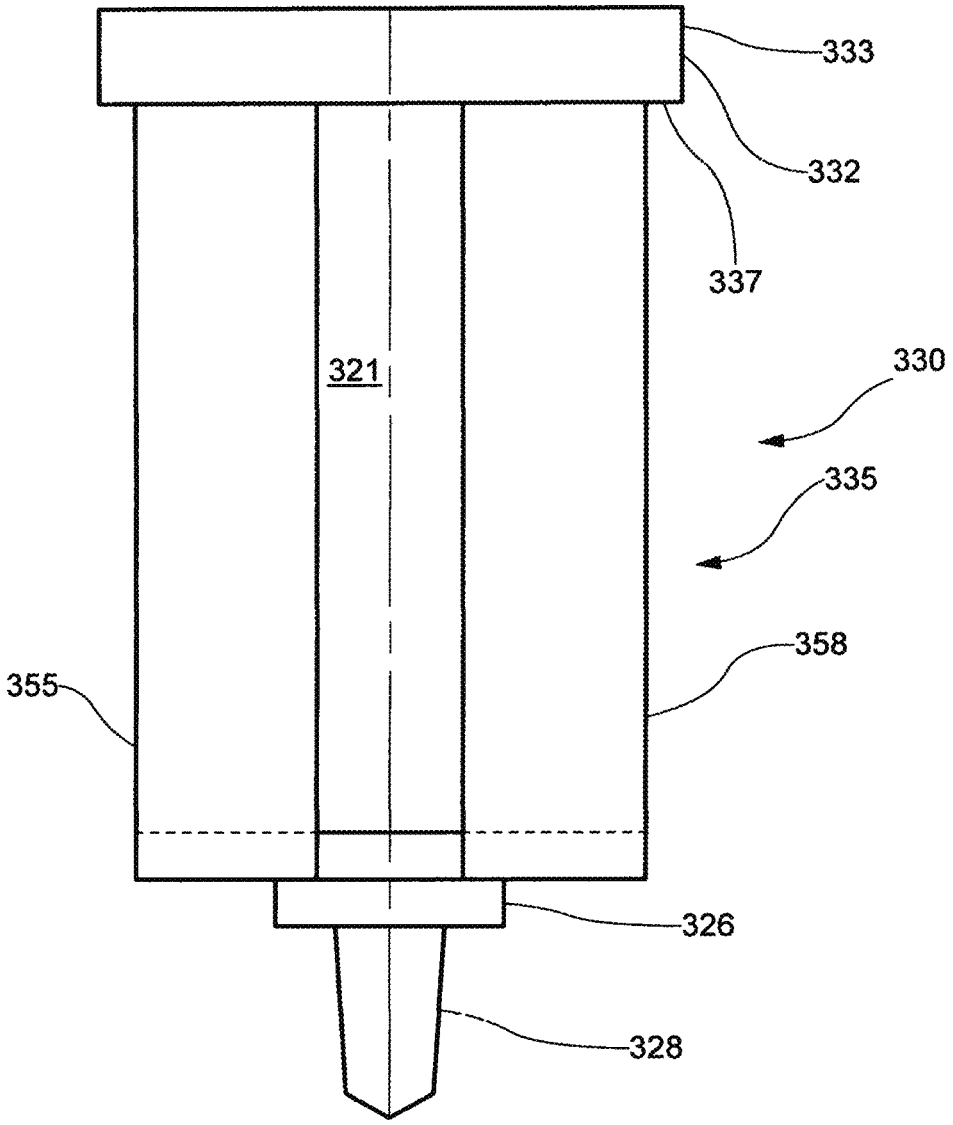
FIG. 11C schematically illustrates a top view of the suction valve spring retainer/plunger spacer.
Figure 12A:
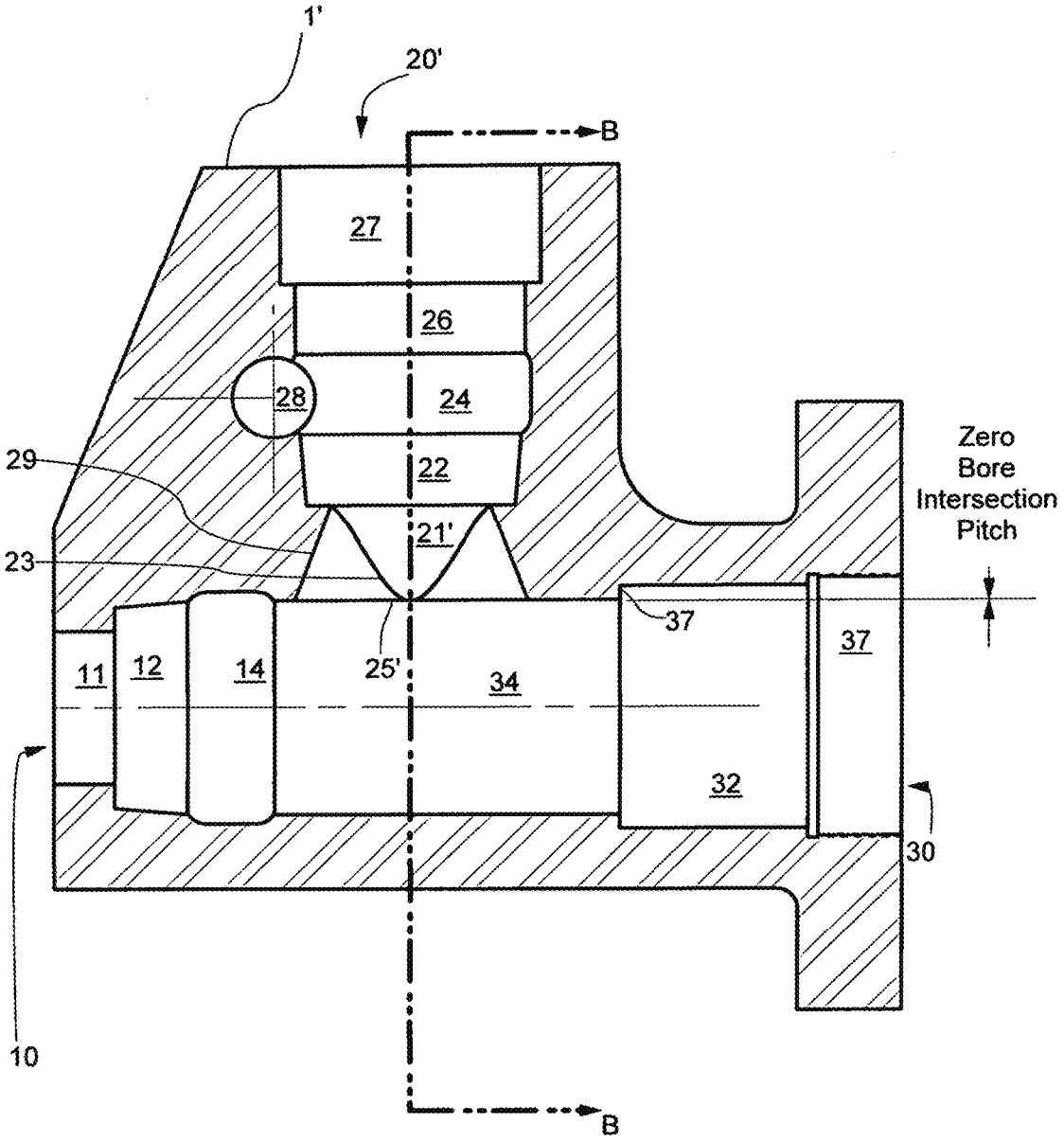
FIG. 12A schematically illustrates a cross-section of an alternate embodiment of the fluid end housing of the present invention.

FIGS. 11A, 11B, and 11C schematically illustrate the suction valve spring retainer/plunger spacer 330. FIG. 11A illustrates an orthogonal view of the suction valve spring retainer/plunger spacer 330. FIG. 11B and FIG. 11C illustrate an end view and a top view, respectively, of the suction valve spring retainer/plunger spacer 330. Suction valve spring retainer plunger spacer 330 is constructed with a packing bore flange 333 with a substantially cylindrical outside surface 332, cylindrical inner surface 336, and a shoulder 337. Central section 335 of suction valve spring retainer/plunger spacer 330 consists of four tangs 355, 356, 357, and 358 that connect packing bore flange 333 with four webs 395, 396, 397, and 398, respectively, that connect with spring retainer 326 and suction valve guide 328. Four ports 314, 315, 316, and 317 located between webs 398 and 395, 395 and 396, 396 and 397, and 397 and 398, respectively, allow passage of pumped fluid from suction valve bore 14 into plunger chamber 34 of fluid end housing 1. Slot 321 located between tangs 355 and 358 allows passage of pumped fluid from plunger chamber 34 into discharge port 21 or 21' of fluid end housing 1 or 1', respectively, as illustrated in FIGS. 10A and 12A. Three identical slots between remaining tangs are non-functional and unlabeled. Broken line 331 in FIG. 11B indicates the rectangular or square cross-section of central section 335 of suction valve spring retainer/plunger spacer 330. Filleted outer surfaces 365, 366, 367, and 368 of tangs 355, 356, 357, and 358, respectively, remove corners of rectangular or square cross section cross section 331 of central section 335. Curved outer surfaces 365, 366, 367, and 368 of tangs 355, 356, 357, and 358, respectively, mates with fillet surfaces 345, 346, 347, and 348 of plunger chamber 34 of fluid housing 1 and 1', respectively, as illustrated in FIGS. 10A and 12A. The order of the mating of the curved surfaces of the tangs with the fillets of the plunger chamber 34 is not specific when the plunger chamber 34 cross-section is square in shape. Inner surfaces 375, 376, 377, and 378 of tangs 355, 356, 357, and 358, respectively, are cylindrical about the center of the central section 335 of suction valve spring retainer/plunger spacer 330. Diameter of combined cylindrical inner surfaces 375, 376, 377, and 378 is slightly greater than diameter of plunger 311, to allow plunger 311 to reciprocate freely within the suction valve spring retainer/plunger spacer 330. Inner surfaces 375, 376, 377, and 378 of tangs 355, 356, 357, and 358, respectively connect with inner surface 336 of flange 333 seamlessly, without surface interruption.

FIG. 12A schematically illustrates a cross-section of an alternate embodiment the fluid end housing of the present invention. Fluid end housing 1' differs only from fluid end housing 1 in the design of the discharge port 21' connecting plunger chamber 34 with discharge bore 20'. All other areas of fluid end housing 1' are identical with similar areas of fluid end housing 1 shown in FIGS. 8. 9, 10A, 10B, and 10C. Similarly all components of fluid end housing assembly 100' (not shown) are identical to fluid end assembly 100 except for the fluid end housing 1' and 1, respectively. Alternate embodiment discharge port 21' contains frusto-conical volume 23 identical to frusto-conical discharge port 21 of fluid end housing 1. In addition, discharge port 21' contains a tapered oblong passage 29 that also connects discharge seat bore 22 with plunger chamber 34. Discharge port 21' intersects plunger chamber 34 at planar section 341 to form oblong intersection 25'.

Figure 12B:
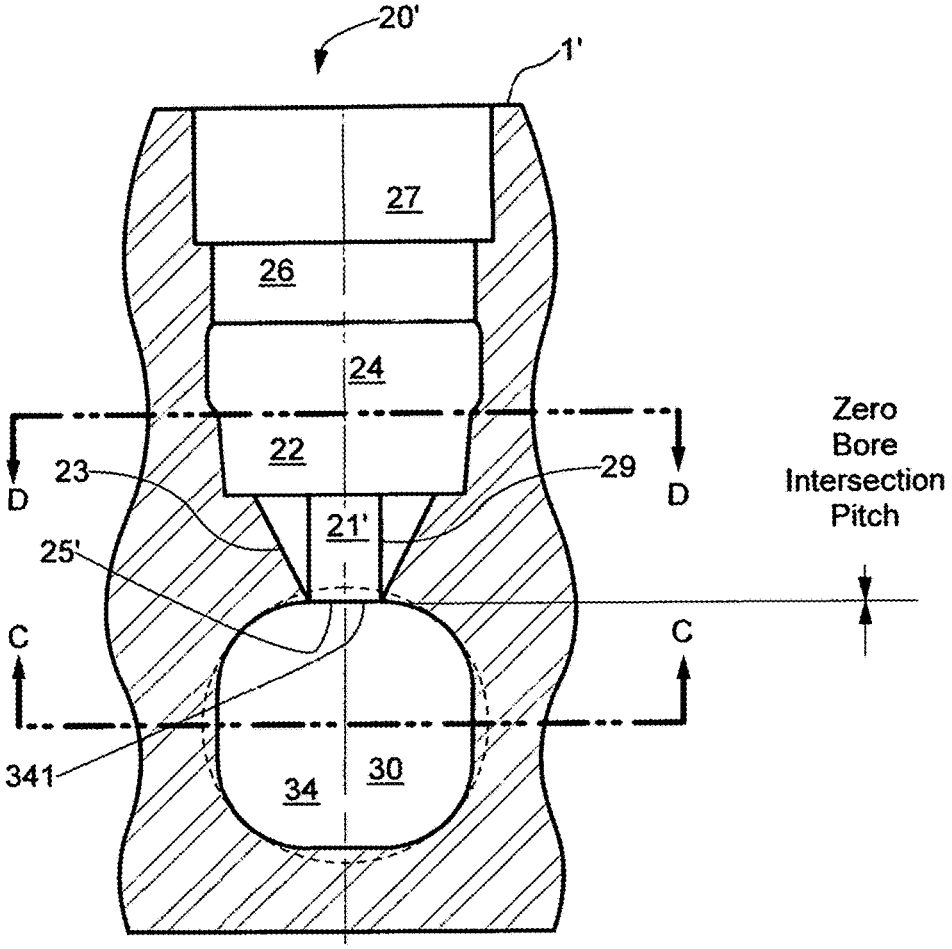
FIG. 12B schematically illustrates the sectional view labeled B-B in FIG. 12A.
Figure 12C:
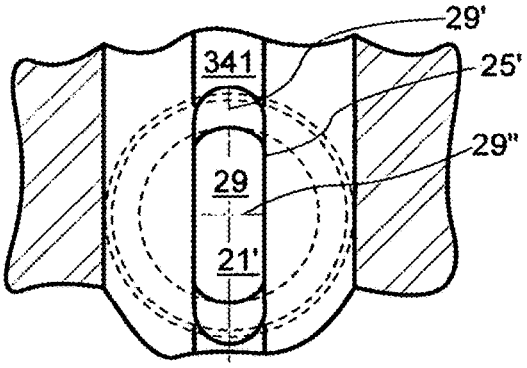
FIG. 12C schematically illustrates the sectional view labeled C-C in FIG. 12B.
Figure 12D:
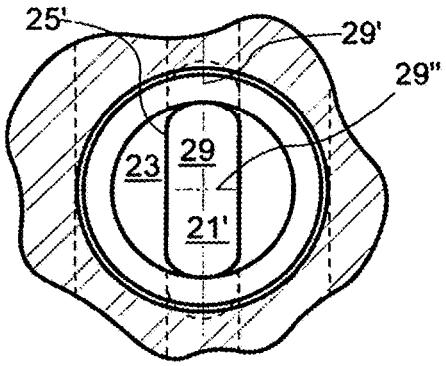
FIG. 12D schematically illustrates the sectional view labeled D-D in FIG. 12B.

As illustrated in FIGS. 12B and 12C, width of the tapered oblong bore 29, along the short axis 29" is equal to or less than the width of planar section 341 of plunger chamber 34 of fluid end housing 1'. As shown in FIGS. 12C-D, tapered oblong bore 29 is only tapered along the long axis 29'. Oblong bore 29 is not tapered along short axis 29". The long axis 29' of tapered oblong bore 29 is parallel to the axis of plunger bore 30 and thus ensures that oblong intersection 25' with plunger chamber 34 occurs wholly within planar section 341. Oblong intersection 25' is totally flat and lies wholly in a two-dimensional plane as compared with bore intersections of conventional fluid ends as shown in FIGS. 3A, 3B, 4, 7A, and 7B which are warped significantly in three-dimensional space. The greater the warpage of the bore intersection, the greater the Bore Intersection Pitch and the greater the concentration of stresses at the bore intersection. The stresses at the intersecting plunger and discharge bores of the present invention are significantly reduced over the stresses at the intersecting bores of the prior art.

The combination of frusto-conical section 23 with tapered oblong bore 29 to form discharge port 21' ensures that cross sectional area of discharge port remains near constant as fluid moves from the plunger chamber through the discharge port 21' into discharge seat 212. Also, the cross sectional area of discharge port 21' approximately equals flow area of suction seat 111 and discharge seat 212 of FIG. 9.

What is claimed is:

1. A plunger pump fluid end housing with multiple fluid chambers arranged in longitudinal plane and each fluid chamber comprising:

a suction bore;

a plunger bore;

a valve spring retainer/plunger spacer in said plunger bore;

a discharge bore;

wherein axes of said suction bore and plunger bore are parallel;

wherein an axis of the discharge bore is substantially perpendicular to said suction bore and plunger axes;

wherein the cross section of a plunger chamber is substantially rectangular and the corners of said substantially rectangular cross section are filleted;

wherein each side of the rectangular plunger chamber, between said corners, is planar in shape;

wherein said valve spring retainer/plunger spacer comprises: four tangs providing an inner surface having a circular cross section and an outer surface complimentary to said substantially rectangular cross section of said plunger chamber; and wherein a port connecting the discharge bore with plunger chamber intersects the said plunger chamber wholly within a planar section.

2. The plunger pump fluid end housing of claim 1, wherein said cross section of said plunger chamber is square.

3. The plunger pump fluid end housing of claim 1, wherein corners of said plunger chamber are filleted with radii approximately equal to a width of a flat area or the planar area on each side of the rectangular or a square cross section of said plunger chamber.

4. The plunger pump fluid end housing of claim 1, wherein the axis of said plunger bore is substantially collinear with the axis of said suction bore.

5. The plunger pump fluid end housing of claim 1, wherein the port connecting the discharge bore with plunger chamber is frusto-conical in shape.

6. The plunger pump fluid end housing of claim 1, wherein the discharge port connecting the plunger bore with the rectangular plunger chamber also contains a tapered oblong section and a long axis of said tapered oblong discharge section is parallel to a plunger bore axis.

7. The plunger pump fluid end housing of claim 6, wherein the oblong discharge port is tapered and a maximum width of said port is greater than a minimum diameter of a discharge seat bore.

8. The plunger pump fluid end housing of claim 6 wherein the flow area of the discharge port is approximately equal to the flow area of the suction port.

9. The plunger pump fluid end housing of claim 6 wherein the flow area of the discharge port at the intersection of said port with the plunger chamber is approximately equal to the flow area at the top of a frusto-conical area of the port connecting the discharge bore with the plunger chamber.

10. The plunger pump fluid end housing of claim 1 wherein a plurality of suction manifold ports of said housing are positioned on the fluid end housing opposite to the power end of the plunger pump.

11. A plunger pump fluid end housing assembly comprising:

a fluid end housing;

multiple plungers;

a single suction valve and seat corresponding with each of said plungers; a single discharge valve and seat corresponding with each of said plungers;

a single suction valve spring retainer/plunger spacer corresponding with each of said plungers;

wherein axes of said suction valve and seat are parallel with an axis of each of said plungers;

wherein axes of said discharge valve and seat are substantially parallel to each other and are substantially perpendicular to the axes of each of said plunger, suction valve, and suction seat;

wherein the cross section of plunger chambers of said housing are rectangular and the corners of said rectangular cross section are filleted;

wherein each side of the rectangular plunger chamber, between said fillets, is planar in shape;

wherein each said valve spring retainer/plunger spacer comprises four tangs providing an inner surface having a circular cross section and an outer surface complimentary to said substantially rectangular cross section of said plunger chamber; and wherein a discharge port connecting the discharge bore with the plunger chamber intersects the said plunger chamber wholly within the corresponding said planar area.

12. The plunger pump fluid end housing assembly of claim 11 wherein the axis of said plunger is substantially collinear with the axes of said suction valve and seat.

13. The plunger pump fluid end housing assembly of claim 11 wherein the flow area of the discharge seat of said assembly equals approximately the flow area of said suction seat in said housing assembly.

14. The plunger pump fluid end housing of claim 11 wherein the port connecting the discharge bore with the rectangular plunger chamber contains an oblong section and a long axis of said oblong discharge port is parallel to a plunger bore axis.

15. The plunger pump fluid end housing of claim 14 wherein the flow area of the discharge port at the intersection of said port with the plunger chamber is approximately equal to the flow area of the discharge seat.

16. The plunger pump fluid end housing of claim 14 wherein the oblong discharge port is tapered and a maximum width of said port is greater than a minimum diameter of a discharge seat bore.

17. The plunger pump fluid end housing of claim 14 wherein the flow area of the discharge port is approximately equal to the flow area of the suction port.

18. The plunger pump fluid end housing of claim 11 wherein a suction manifold of said housing assembly is positioned opposite to the power end of the plunger pump.

19. The plunger pump fluid end housing of claim 1, wherein said corners of said substantially rectangular cross section of said plunger chamber are filleted with radii having a range between 50 percent to 70 percent of the radius of a plunger packing bore.

20. The plunger pump fluid end housing of claim 11, wherein said corners of said substantially rectangular cross section of said plunger chamber are filleted with radii having a range between 50 percent to 70 percent of the radius of a plunger packing bore.

* * * * *